US006389993B1

(12) United States Patent
Ondrasik

(10) Patent No.: US 6,389,993 B1
(45) Date of Patent: May 21, 2002

(54) SHELVING, SHELF ASSEMBLY AND COMPONENTS THEREOF

(75) Inventor: V. John Ondrasik, Granada Hills, CA (US)

(73) Assignee: Anthony, Inc., San Fernando, CA (US)

( * ) Notice: Subject to any disclaimer, the term of this patent is extended or adjusted under 35 U.S.C. 154(b) by 0 days.

(21) Appl. No.: 09/410,822

(22) Filed: Oct. 1, 1999

Related U.S. Application Data

(63) Continuation-in-part of application No. 09/102,995, filed on Jun. 22, 1998.

(51) Int. Cl.[7] ..... A47B 9/00

(52) U.S. Cl. ..... 108/107; 108/147.11; 211/175; 211/187

(58) Field of Search ..... 108/106, 107, 108/108, 110, 147.11, 157.13; 211/175, 187, 184, 59.2, 59.3

(56) References Cited

U.S. PATENT DOCUMENTS

| | | | | |
|---|---|---|---|---|
| 2,891,677 | A | | 6/1959 | Ritchie |
| 2,897,978 | A | | 8/1959 | Beckner |
| 2,933,195 | A | | 4/1960 | Radek |
| 3,007,708 | A | | 11/1961 | Ochs |
| 3,183,862 | A | * | 5/1965 | Melvin |
| 3,194,528 | A | * | 7/1965 | Chesley |
| 3,225,719 | A | | 12/1965 | Marschak |
| 3,338,423 | A | | 8/1967 | Wellman |
| 3,343,506 | A | * | 9/1967 | Buchbinder et al. |
| 3,388,808 | A | | 6/1968 | Radek |
| 3,698,568 | A | * | 10/1972 | Armstrong ..... 211/184 |
| 3,730,108 | A | * | 5/1973 | Stroh |
| 3,844,416 | A | | 10/1974 | Potter |
| 3,900,112 | A | | 8/1975 | Azzi et al. |
| 3,993,002 | A | * | 11/1976 | Stroh |
| 4,079,678 | A | | 3/1978 | Champagne |
| 4,190,167 | A | * | 2/1980 | Wells et al. |
| 4,331,243 | A | | 5/1982 | Doll |
| 4,348,001 | A | | 9/1982 | Baldwin |
| 4,453,641 | A | | 6/1984 | Rasmussen et al. |
| 4,729,485 | A | * | 3/1988 | Kullbersh ..... 211/184 |
| 4,765,493 | A | | 8/1988 | Kinney |
| 4,955,490 | A | | 9/1990 | Schafer |
| 5,090,547 | A | | 2/1992 | Schafer |
| 5,127,340 | A | | 7/1992 | Maro et al. |
| 5,221,014 | A | | 6/1993 | Welch et al. |
| 5,279,430 | A | | 1/1994 | Benton |
| 5,360,122 | A | * | 11/1994 | Benton |
| 5,474,412 | A | | 12/1995 | Pfeiffer et al. |
| 5,607,068 | A | | 3/1997 | Coretti, Jr. et al. |
| 5,641,083 | A | * | 6/1997 | Metcalf |
| 5,806,417 | A | | 9/1998 | Whiten et al. |
| 5,845,794 | A | | 12/1998 | Highsmith |
| 5,921,412 | A | | 7/1999 | Merl |
| 6,044,989 | A | * | 4/2000 | Sosso ..... 211/189 |

FOREIGN PATENT DOCUMENTS

| | | |
|---|---|---|
| CA | 1085777 | 9/1980 |
| GB | 992227 | 5/1965 |
| SE | 205195 | 9/1966 |

* cited by examiner

*Primary Examiner*—Peter M. Cuomo
*Assistant Examiner*—Hanh V. Tran
(74) *Attorney, Agent, or Firm*—Henricks, Slavin & Holmes

(57) ABSTRACT

A shelving system, shelf assembly and components are easily retrofit on existing shelves for improved product presentation, stocking and maintenance. Shelf assemblies may include improved adjustable product stops and dividers, and improved rollers for automatic advance of product.

24 Claims, 9 Drawing Sheets

SHELVING, SHELF ASSEMBLY AND COMPONENTS THEREOF

CROSS REFERENCE TO RELATED APPLICATION

This is a continuation-in-part of Ser. No. 09/102,995 filed Jun. 22, 1998, incorporated herein by reference.

BACKGROUND OF THE INVENTION

1. Field of the Invention

This invention relates to display systems and shelf systems, for example systems used for displaying product in refrigerated display cases.

2. Related Art

Conventional shelving systems, for example those used in refrigerated display cases, have a number of configurations, including fixed or adjustable wire shelves, gravity feed shelving systems, and the like. Many of these shelving systems are relatively difficult to use and are costly to make.

In refrigerated display cases, wire shelves are common and may be stainless steel or plastic or rubber-coated wire. Wire shelves are strong, sturdy and easy to clean. They also permit ventilation of cold or refrigerated air so that all locations in the display case are preferably at the same temperature.

A gravity feed shelving configuration positions one or more shelves on an incline downwardly from the rear to the front of the display case. Inclined or slanted shelving reduces the need for stocking personnel to regularly inspect the shelves and advance product to the front of the shelves. Slanted shelves, at predetermined angles, allow gravity to move product to the front of the shelf. These slanted, gravity-fed shelving arrangements are convenient, but are sometimes difficult to properly position for different product to achieve the appropriate product movement. For example, for beverage containers which are relatively heavy compared to similarly sized packages of dry goods, a lesser incline may be used to adequately advance product on a slanted shelf. However, too much of an incline may apply too much pressure from rearwardly stocked product on the forward-most product, making that product more difficult to remove, and also possibly unintentionally removing or ejecting following product.

Some shelving systems include shelf divider arrangements to improve product alignment on the shelf and to insure proper advancement of product toward the front of the shelf either manually or through gravity feed. These divider arrangements may differ from one shelf system to another, and may not serve the intended function uniformly for different shelf systems.

SUMMARY OF THE INVENTIONS

A shelving system and shelf are disclosed that can be easily assembled and have product guides and gravity advance mechanisms. They may include dividers or product stops to improve product presentation and stocking procedures, and the apparatus may be easily retrofit onto existing shelves.

In one preferred embodiment of one aspect of the present inventions, a shelf assembly is provided which helps to support, guide and insure the desired positioning of product on a shelf. The assembly is sturdy and can be used with a number of different types and sizes of product, including beverage-filled containers such as cans, bottles and cartons, as well as multiple packs of product. In one preferred embodiment, a shelf assembly includes a front product stop having side elements extending rearwardly. The side elements preferably include support portions extending at least partly forwardly for engaging support elements mounted on the shelf. The support portions on the side elements extend at least partly forwardly so that product hitting the front product stop will tend to keep the front product stop engaged with the support elements on the shelf. The shelf assembly is easy to assemble and reliably supports and guides product.

In another embodiment of one aspect of the present inventions, a shelf includes first and second supports supported by the shelf wherein each support includes at least one receiver. A product guide is positioned above the shelf and includes at least one support element for engaging at least one receiver in the support. The at least one support element extends at least partly forwardly relative to the shelf for engaging the receiver. In a preferred embodiment, the first and second supports are removable so they can be used to retrofit existing shelves. Additionally, the first and second supports include multiple receivers so that the product guide can be supported at any number of different levels above the shelf. In another preferred embodiment, a shelf includes four supports so that the product guide is supported on the shelf at four different locations. Each of the supports are preferably removable and include multiple receivers so the product guide can be supported at the same level at each of the four points around the shelf. The supports are preferably held in place on a shelf through fasteners and a backing plate which sandwich a wire or other element on the shelf between the backing plate and the support. Each support preferably includes oval or other eccentric openings for the fasteners to accommodate different-sized wires on the shelf. In a still further embodiment, the shelf assembly can include a divider extending rearwardly from the front product stop to a rear product stop. Preferably, the divider engages the front product stop from behind and engages the rear product stop from behind. In this configuration, it is more difficult for product movement to disengage the divider.

In accordance with another aspect of one of the present inventions, a roller assembly for a shelf or other product or item support includes a roller support having at least one wall forming an axle support wall and having an outwardly extending projection for engaging a surface of a shelf. A roller has an axle that rests in and is supported by the axle support wall. The roller support preferably retains the roller and is in turn held in place on a shelf in part through the engagement of the projection with the surface of the shelf. Preferably, the projection engages an underside of the shelf surface and inhibits the roller assembly from lifting off of the shelf.

In one preferred aspect of one of the present inventions, the roller support is a roller tray supporting a number of rollers so that product placed on the shelf can easily move toward the front of the shelf on the rollers. In many instances, the shelf is a wire shelf and the roller tray has projections on each side of the tray for contacting respective portions of the shelf, and the projections extend a substantial portion of a length of the tray.

In another aspect of one of the present inventions, an opening is formed in the tray to allow the tray to fit over support wires or other support elements formed in the shelf. More than one opening may be formed in the tray, for example in regular intervals, to accommodate multiple support elements, or to allow positioning of the tray on different shelves having support elements located at different positions.

In another aspect of one of the present inventions, a shelf and roller assembly are provided wherein the shelf has at least first and second side elements defining at least one longitudinally extending opening. A roller support includes a first roller support side having an inner and outer sides, the outer side including at least one projection extending outwardly away from the roller support for contacting a lower surface of the first side element of the shelf. The roller support also includes a first shelf contact surface such as a flange, lip, ledge or shoulder for contacting the first side element of the shelf for helping to prevent the roller support from passing completely through the opening. The projection on the roller support helps to keep the roller support in the opening in the shelf. Where the shelf is a wire shelf, the first shelf contact surface rests on top of a wire and the projection contacts a lower portion of the wire to help keep the roller support in place. In one preferred embodiment, the first shelf contact surface and projections extend the length of the roller support. Where the roller support is a closed-bottomed tray, channels or openings are formed in a bottom of the tray to accommodate support structures of the shelf. In another embodiment, the rollers include axles that are supported below the first shelf contact surface and in the region of the projections. This allows the rollers to be positioned relatively high in the tray, while keeping the rollers in place and reducing the possibility that the rollers work loose.

In another aspect of one of the present inventions, rollers are used in the tray having grooved or slotted circumferential surfaces. Such rollers can be placed closer together so that product or other items can more easily roll over the tops of the rollers. Such inter-fitting rollers would present less of a gap or a shorter gap between rollers, reducing the likelihood that the edge of a product might dip down between rollers, causing the product to tip or fall. Grooved rollers are preferably supported on axles above a flange resting on the surface of the shelf.

In another aspect of the inventions, a shelf is provided for supporting and displaying products. It includes a substantially planar shelf portion and a laterally extending element extending across the front, rear or other portion of the shelf and having a number of engagement surfaces for engaging the product support. The laterally extending element may be an aperture bar extending across the front of the shelf, and the product support may be a divider or other bar or wire for positioning product or making it easier to move product on the shelf. The aperture bar may be adjustably fixed to the shelf so that the bar may be raised, lowered or otherwise repositioned as desired. The aperture bar preferably accepts and holds in position one or more dividers having hooks, prongs or other mounting elements for engaging the aperture bar. The aperture bar can also serve as a product stop at the front of the shelf. An aperture bar can also be placed at the rear of the shelf for holding one or more dividers and also for minimizing the possibility of product being pushed off the rear of the shelf. In one preferred embodiment, the product stop is mounted so that movement of product will tend to ensure that the product stop and any dividers remain engaged.

These and other aspects of the present inventions will be more fully understood after a consideration of the brief description of the drawings and the detailed description of the preferred embodiments.

DETAILED DESCRIPTION OF THE PREFERRED EMBODIMENTS

Figure 1:
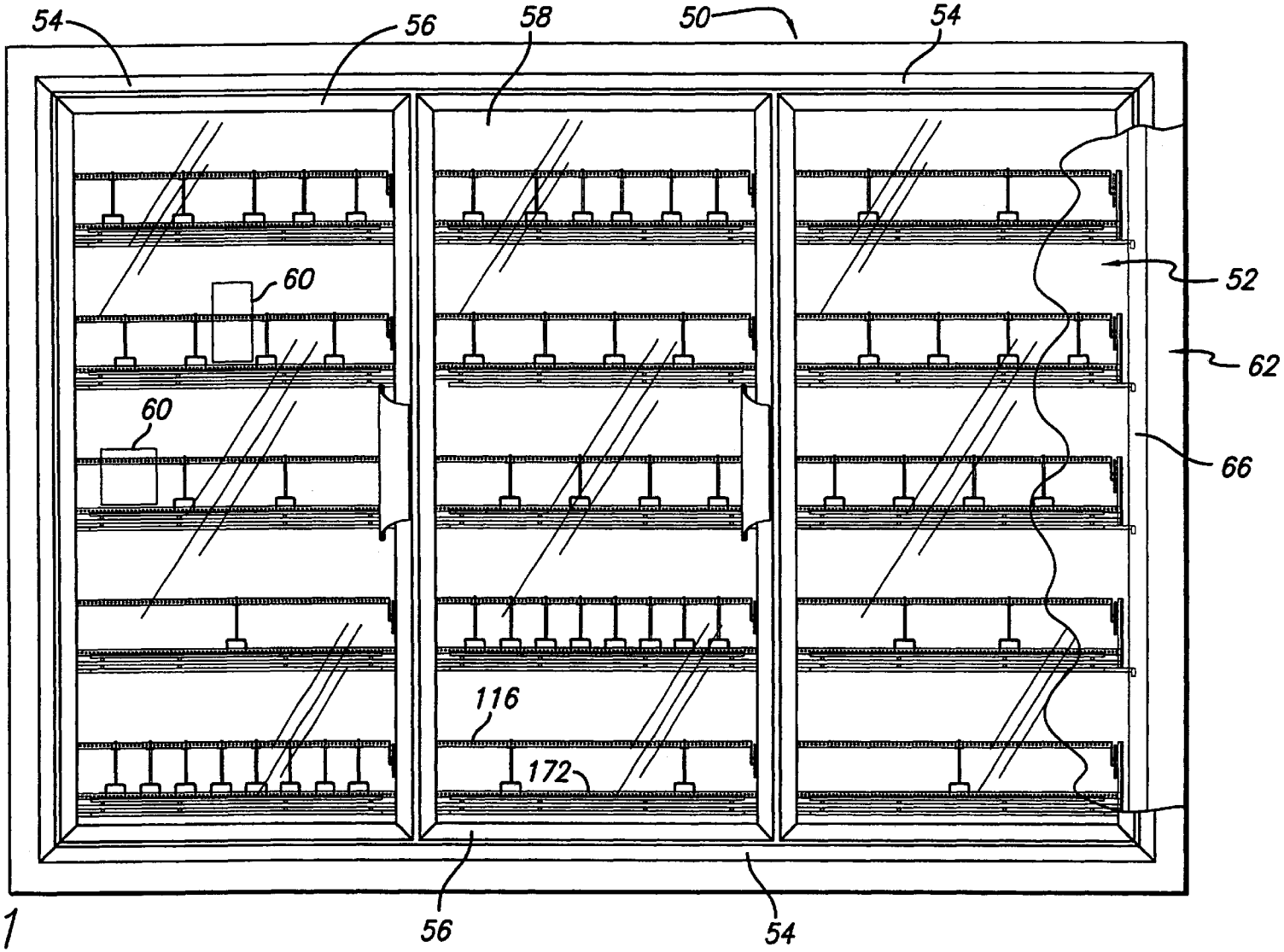
FIG. 1 is a front elevation view and partial cutaway of a product display case showing shelves and dividers in accordance with one aspect of the present inventions.
Figure 2:
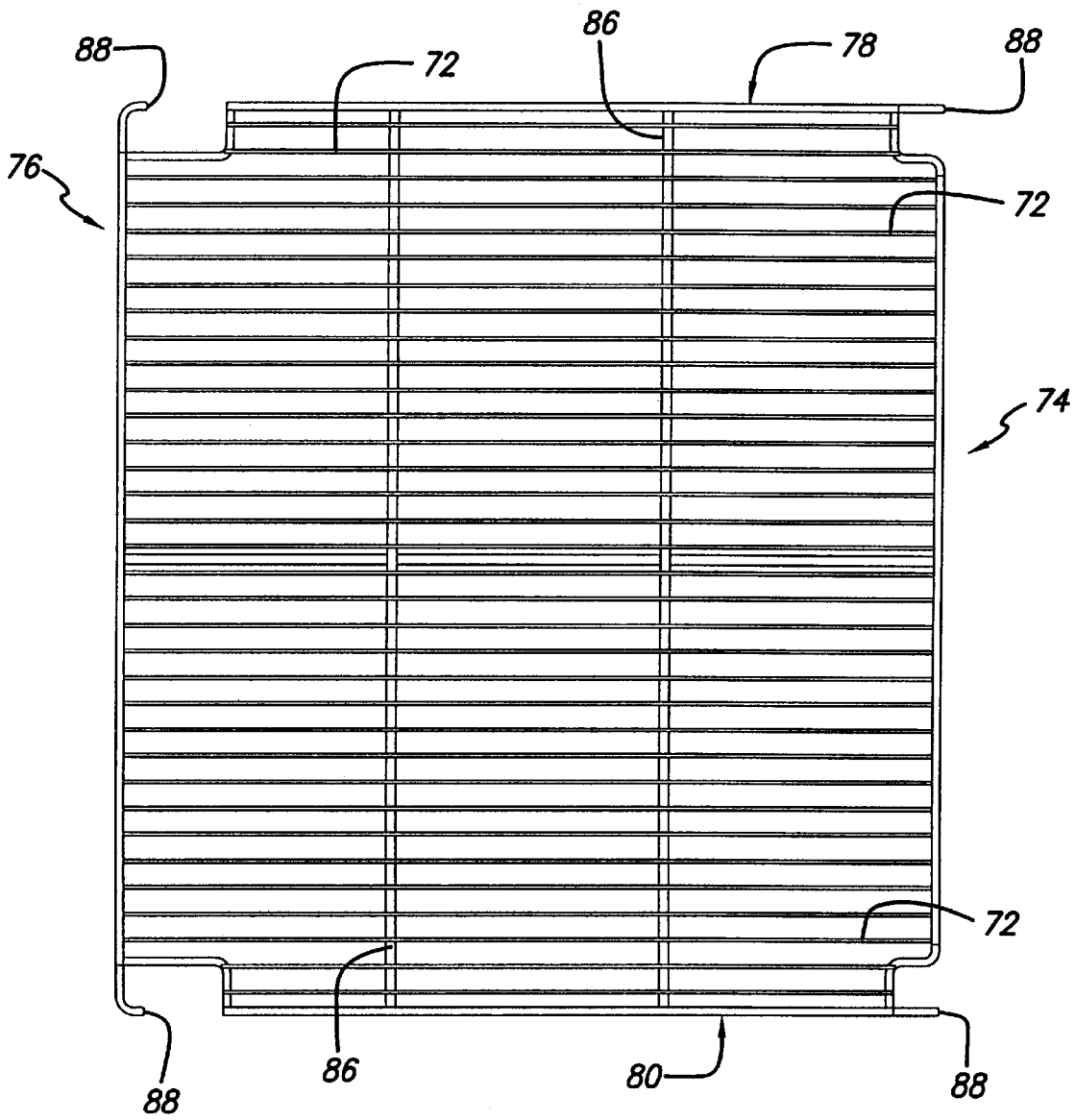
FIG. 2 is a plan view of a conventional wire shelf retrofitted with a product stop and means for accepting and holding shelf dividers.

A shelving system, shelf assembly and components therefor are disclosed that provide easy assembly and retrofit onto existing shelves. They are reliable and withstand many of the impacts and other effects that occur in product display cases, especially with large packages or heavy products such as beverage containers or packs.

Product displays find application in many areas of consumer wholesale and retail marketing. Food products and other consumables are often displayed to consumers and other purchasers on shelf displays that may take any number of different configurations. For example, the shelf displays may be portable or fixed to a store floor or wall section. The shelf display may be a single shelf or multiple shelves, different types and sizes, adjustable or fixed, flat or sloped or slanted, or any number of other configurations. For the present discussion, the description of the shelving assembly and shelf configurations will be given in the context of refrigerated display cases, such as those found in grocery stores, convenience stores and the like. However, it should be understood that the invention is not limited to refrigerated display cases, food or other consumable products, but can be extended and is applicable to other display applications and shelving systems.

In the context of refrigerated display cases 50 (FIG. 1), a shelving system 52 may be placed inside a cabinet having a frame 54 surrounding and supporting a number of doors 56. The doors 56 typically include glass panels 58 to permit viewing a product 60 inside the display case and to permit access to the product 60. The cases 50 are often designed so as to maximize the product capacity of the case, maximize the viewing area for the customer, and to maximize the shelf space available for displaying and stocking product. Consequently, the shelving system 52 preferably accommodates a large amount of product per shelf, different types and sizes of product, such as boxes, plastic and glass containers, beverage cans, and round and rectangular containers, and with different presentations. The shelving system 52 also preferably permits gravity feed of product, common in grocery stores and convenience stores.

In one embodiment of a shelving system 52 (FIG. 1), the shelving system includes a frame structure 62 which may rest freely on the floor, be fixed to the floor through bolts, or to the surrounding frame through brackets or straps, or supported by casters. The present invention is not limited to a particular type of frame structure or its mobility. In one preferred embodiment, the frame structure 62 includes a front shelf post 66 and a rear shelf post for supporting one or more shelf assemblies 68. While a given shelf assembly will typically include corresponding or paired left and right shelf posts, only the right shelf post is shown in FIG. 1. Additionally, shelf posts are not required to practice the invention, and other shelf supports such as wall units, panels or other structures which can support and engage mounting brackets for supporting shelf assemblies can also be used. However, because shelf posts are common in the grocery and other food product industry, the description of the shelving system will be made in the context of discrete shelf posts assembled into a frame structure 62. The shelf posts may extend vertically, horizontally or at an angle, as desired. The shelf posts may be conventional shelf posts known to those skilled in the art, and which may support adjacent shelf, permit shelf height adjustment through openings and permit positioning of the shelf in an incline configuration for gravity feed of product.

In refrigerated display cases, conventional shelves are typically wire shelves and are similar to those shown in U.S. Pat. Nos. 5,301,092 and 5,605,237, incorporated herein by reference. The shelves typically include longitudinally extending wire running from front to back of the shelf. Upper and lower perimeter wires sandwich the forward and rearward ends of the longitudinal wires as well as any laterally extending edge wires on the shelf. The upper perimeter wire typically serves as a rim or top edge which may prevent placement of product on the edge of the shelf in such a way that the product falls off the shelf. If any product is placed on the upper perimeter wire, the upper perimeter wire may cause the product to be tilted toward the center of the shelf, thereby minimizing the possibility that the product will fall from the shelf.

The shelf assembly 70 may take a number of forms and still adequately function in any number of the ways described herein. In several of the embodiments, the shelf assembly may simply be a conventional wire shelf with one or more of the additional features described herein. Because many conventional refrigerated display cases use wire shelves, the discussion of the shelf assembly will be made in the context of a wire shelf.

In one preferred embodiment, a shelf assembly 70 (FIG. 3) includes a grill or array of wires 72 for supporting product. The wires 72 extend longitudinally from the front of the shelf 74 to the rear 76. The longitudinally extending wires 72 are the wires on which product rest. The wires 72 are formed with a thickness and are spaced apart a distance sufficient to adequately support the product. The wires are typically formed from steel or other suitable metal and coated with a plastic or other suitable impervious material, as is known to those skilled in the art.

The shelf has a first or right side 78 and a second or left side 80. The relative descriptions of left and right, and front and rear, are used in the context of refrigerated display cases. The point of reference is typically from the viewpoint of a customer looking at product from outside the display case. However, these descriptions are used to help understand the apparatus, and are not intended to limit the interpretation of the structure, function or application of the shelf system. The dimensions of the shelf are preferably maximized to permit display of or to permit stocking a maximum amount of product. The wires 72 are typically positioned along substantially the entire length of the wire shelf, and are supported around the perimeter by upper and lower support rails 82 and 84 (FIG. 3), which strengthen the shelf and the wires 72. The support rails 82 and 84 form a frame surrounding the wires 72, and define the shape of the shelf. The wires 72 are also supported and strengthened by one or more lateral supporting cross bars 86 in the conventional manner, as is known to those skilled in the art of making product display shelves.

The shelf assembly 72 also typically includes one or more shelf support elements or hooks 88 for engaging the shelf and also for engaging at least one of the holes or other shelf assembly support surfaces in a bracket, shelf post or other shelf support structure. The shelf supports 88 are positioned on both the left and right sides of the shelf so that the shelf is supported on both sides thereof and to provide proper support for the shelf assembly. The shelf support elements 88 can be positioned almost anywhere on the shelf assembly, such as the front, sides or rear portions of the shelf, but are typically positioned on each side of the shelf and at the corners of the shelf.

Conventional flat, wire shelves can be repositioned on the shelf posts so that they are slanted downwardly from back to front. Depending on the configuration of the shelf and the type of product placed on the shelf, the slant of the shelf can be enough to allow the product to slide forward to the front of the shelf. When a customer removes a product from the front of the shelf, product immediately behind will slip or slide forward. This automatic repositioning keeps product easily visible and accessible at the front of the shelf, for easy viewing and selection.

Because movement of the product on a slanted shelf may sometimes be difficult to control, for example if the display case is rattled by a slamming door, guide bars, product stops and dividers are often included on slanted shelves. Front product stops are positioned at the front of a shelf to stop product and to keep advancing product from falling off the shelf. A front product stop is especially useful when tall product or heavy product is displayed on the slanted shelf, and helps to keep the product from tipping forward and falling off the shelf. Rear product stops are also useful for reducing the possibility of product falling off the back of the shelf, especially when store personnel stock shelves from the front. Often, shelves are re-stocked by pushing existing product toward the back of the shelf and placing new product at the front. A rear product stop helps to keep existing product from falling off. Slanted shelves will also have side product supports or guides at the sides of the shelves to keep product from falling off the sides of the shelves. Side product guides also help to keep product aligned on the shelf. Shelf dividers or lane dividers are also typically included on slanted shelves to help keep product from falling sideways and to help keep product aligned on shelf. Shelf dividers are positioned between the sides of the shelf, and extending front to back.

Often, refrigerated display cases and other product display cases do not include extra components such as product stops and guides allowing the shelf to be configured for automatic product advancement. Where store proprietors wish to convert conventional flat shelves to slanted shelves, retrofit assemblies can be provided for adding product stops and guides. In one form of one aspect of the present inventions, product stops and guides can be installed on conventional shelves through suitable mounting hardware.

In one aspect of an embodiment of the present inventions (FIGS. 3–8), a combination product stop and guide assembly 90 can be retrofit onto conventional wire shelves. The assembly 90 includes one or more product stop support elements or brackets 92, including a left front bracket 94, a right front bracket 96, a left rear bracket 98 and a right rear bracket 100, for supporting the front and rear product stops and for supporting any dividers which may be used on the shelf assembly. The left and right assemblies are preferably arranged as mirror images of each other. Each bracket 92 permits the level of the front and rear product stops to be adjusted, and also permits the level of any left and right side product stops or guides to be adjusted. Each bracket 92 preferably includes a groove 102 extending longitudinally through a base 104 of the bracket for receiving two side rails from the shelf so that the bracket can be mounted on the shelf. The base 104 of the bracket is placed over the upper reinforcing wire or support rail 82 and the lower reinforcing wire or support rail 84 on the shelf and preferably locked in place through push rivets (not shown) passing through holes 106 through the base. A backing plate 107 having holes 107A matching the relative spacing of the holes 106 in the base may also be used to hold the brackets on the shelves. The backing plate is placed on the inside of the bracket (inside relative to the shelf) and serves as a back for fasteners such as bolts and nuts passing through the holes 106 to secure the bracket on the shelf.

The support brackets 92 also preferably include a mounting element such as an enclosed wall 108 for receiving and holding an end of a rear product stop, described more fully below. A number of slots, grooves, openings, receivers or other support surfaces 110 are formed vertically aligned above the base 104 to receive, support and hold a respective support element, engagement extension or bar, labeled generically as 112, on a front product stop and product guide assembly 114. The openings 110 preferably extend entirely through the bracket 92 to accommodate tolerances in the assembly. The openings 110 are dimensioned so as to receive and reliably support the bars 112, given the size and configuration of those extensions. The openings are preferably aligned exactly vertically to give the desired amount of adjustability in the product stop and divider assembly. The openings may be formed straight through the bracket, or may include one or more counter bores to make insertion of the extensions easier.

The front product stop and guide assembly 114 includes a front product stop and aperture bar 116. The product stop reduces the possibility of product falling from the front of the shelf assembly. The front product stop can be positioned at any number of selected positions above the wires 72. The front product stop 116 is preferably adjustable in vertical position above the wires 72 so that the product stop can be positioned above the center of mass of the product to be placed on the shelf.

The front product stop 116 is preferably sufficiently strong to absorb impact from large and small containers, including beverage containers, when the shelf is placed at angle for gravity feed. The product stop 116 is preferably formed at least from an angle bar, and preferably from metal sheet formed into a square cornered, U-shaped bar for structural integrity.

The front product stop and guide assembly 114 also includes left and right side elements 118 and 120, respectively, extending rearwardly from the front product stop and aperture bar 116. The left and right side elements 118 and 120 help to support and guide product on the shelf, from the sides, and includes the support portions or engagement elements 112. Specifically, the left side element 118 includes a left engagement pin 122 5 extending at least partly forwardly and preferably straight forward to engage an opening in the left front bracket 94. The right side element 120 includes a right engagement pin 124 also preferably extending straight forward to engage an opening in the right front bracket 96. Having the pins 122 and 124 pointing forwardly to engage the respective brackets helps to ensure that the assembly 114 stays engaged with the supporting brackets even if large or heavy product hits the front product stop. Impact by product against the front product stop would tend to further engage the pins 122 and 124 with their respective brackets.

The left and right side elements 118 and 120 extend rearwardly to respective outwardly extending angle arms 126 and 128 and then straight rearwardly again to respective flattened end bars 130 and 132. The flattened end bars 130 and 132 include respective holding racks 134 and 136 to help hold the assembly on respective brackets 92. The flattened end bars 130 and 132 extend into or through selected openings 110 in brackets 92. The holding racks 134 and 136 preferably engage the brackets 92 to minimize the amount of forward and backward movement of the assembly 114 relative to the brackets 92. Each rack preferably includes a common bar 138 (FIG. 8) with a first leg 140 having a horizontal portion 142 extending away from the common bar 138 substantially horizontally, relative to the shelf surface, and a substantially vertical portion 144. The vertical portion 144 engages and preferably extends through an end opening 146 in the flattened portion of the end bar. A second leg 148 also includes a relatively horizontal leg 150 and a relatively vertical leg 152. The leg 152 engages and preferably extends through a middle opening 154 in the flattened portion of the end bar. The first and second legs preferably surround and capture the vertical portion of the bracket 92 so as to limit the forward and backward movement of the assembly 114.

Each holding rack also preferably includes an anchor leg 156 having an enlarged end portion 158. The anchor leg is preferably long enough to allow the first and second legs 140 and 148 to disengage from the flattened end bar and clear the bracket, permitting the assembly to be removed from the bracket. The enlarged end portion 158 captures and retains the rack on the respective flattened end portion. The holding rack and the flattened end portions form the engagement portions 112 for the rear of the assembly 114. As is apparent, the assembly 114 can be adjusted vertically upward or downward in the brackets 92.

The assembly 114 is preferably installed by first inserting the flattened end bars 130 in the desired receivers 110 in the brackets 92, with the rack 134, 136 disengaged. The end bars are inserted beyond their normal locked positions in the rear brackets 98 and 100 to give sufficient room for the pins 122 and 124 to be next inserted into the receivers 110 in their respective brackets 94 and 96. Once the pins are inserted, the assembly can be shifted forward relative to the shelf and the racks 134 and 136 engaged with the end bars 130 and 132 and locked about the brackets. Then, the assembly does not move forward or backward appreciably without disengaging the racks.

Figure 3:
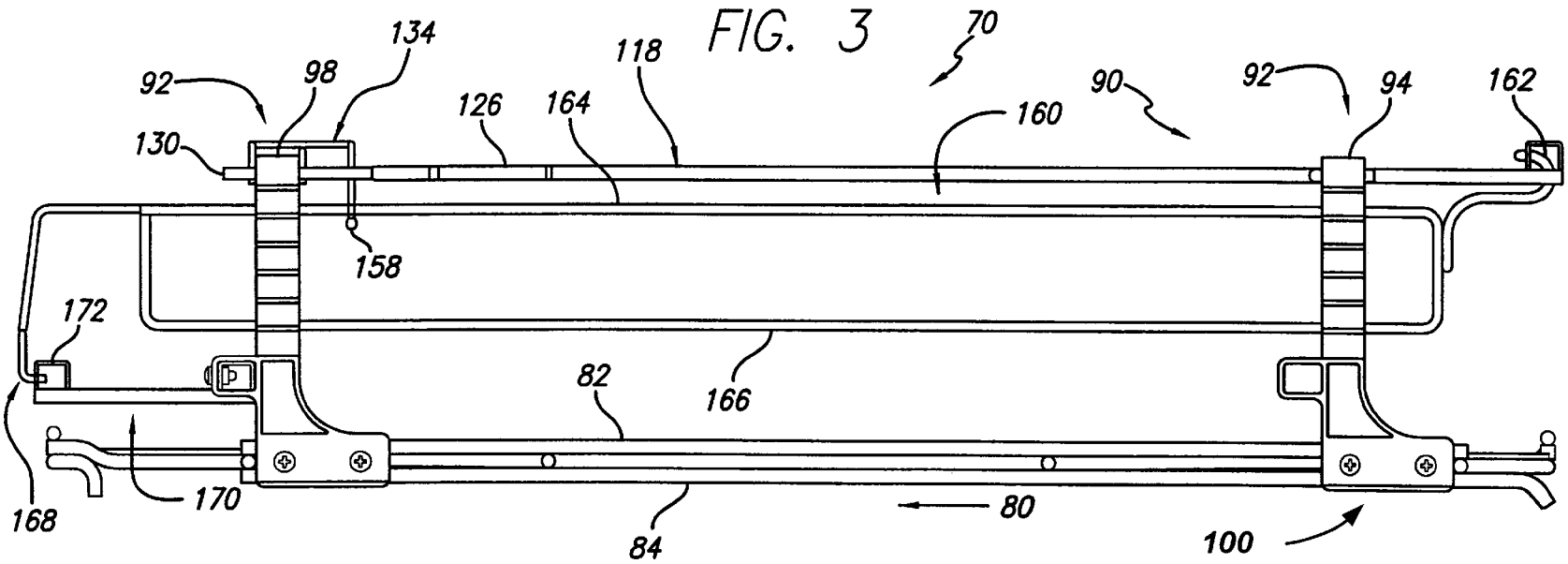
FIG. 3 is a side elevation view of the shelf assembly of FIG. 2.
Figure 4:
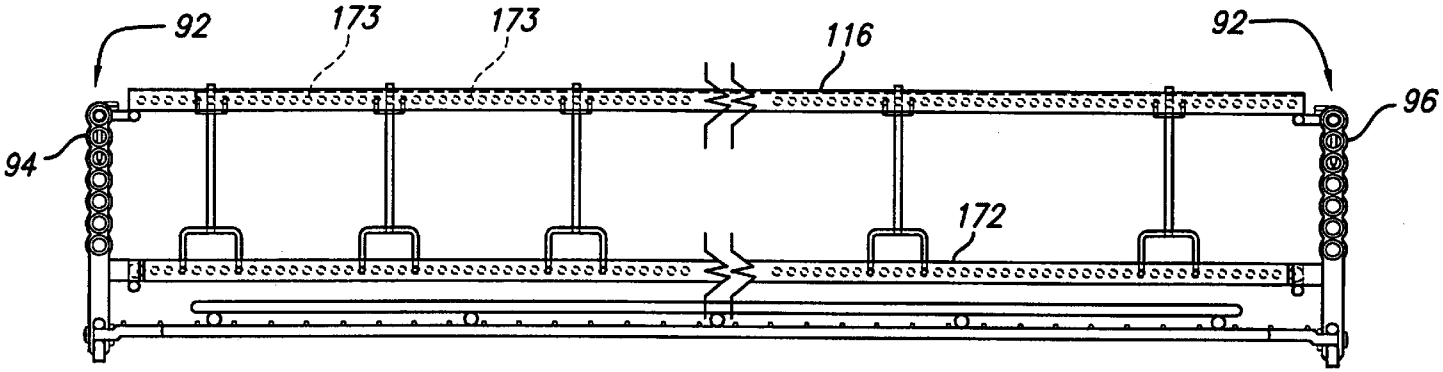
FIG. 4 is a front elevation view of the shelf assembly of FIG. 2 showing dividers positioned on the shelf.
Figure 5:
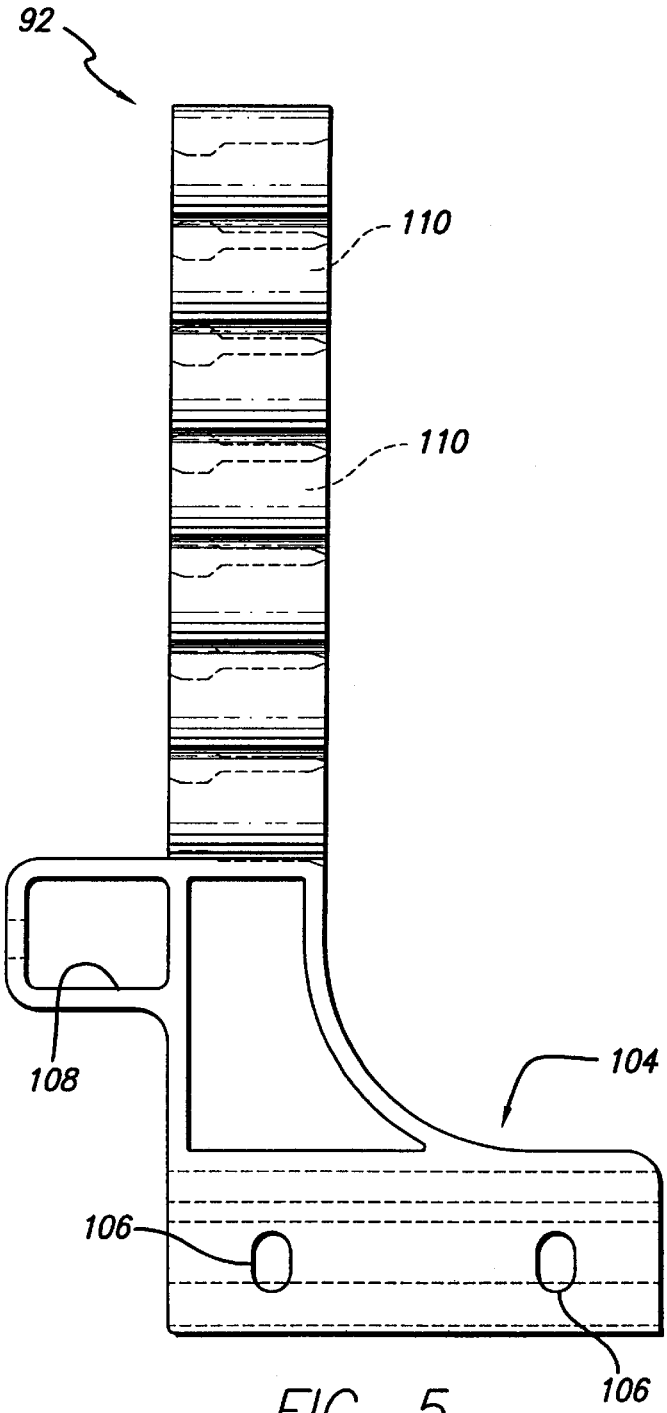
FIG. 5 is a side elevation view of a bracket for use in assembling the shelf assembly of FIG. 2, and which can be used to retrofit existing shelves.
Figure 6:
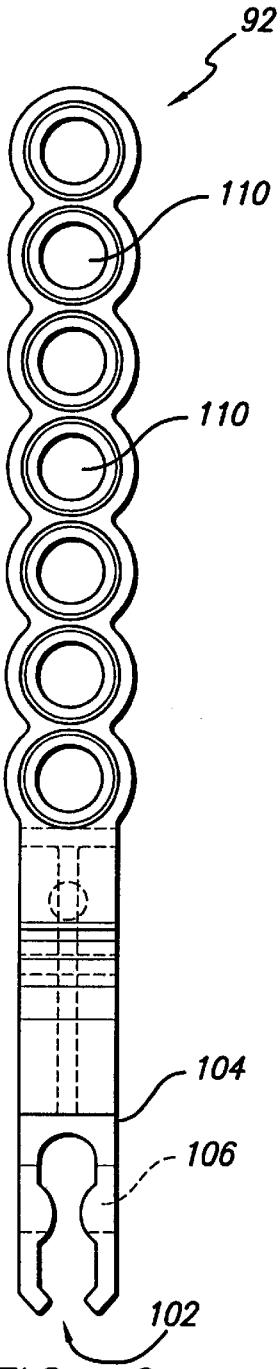
FIG. 6 is a right side elevation view of the bracket of FIG. 5.
Figure 5A:
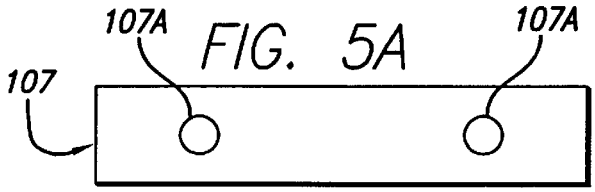
FIG. 5A is a side elevation view of a backing plate for use with the bracket of FIG. 5.
Figures 7, 8:
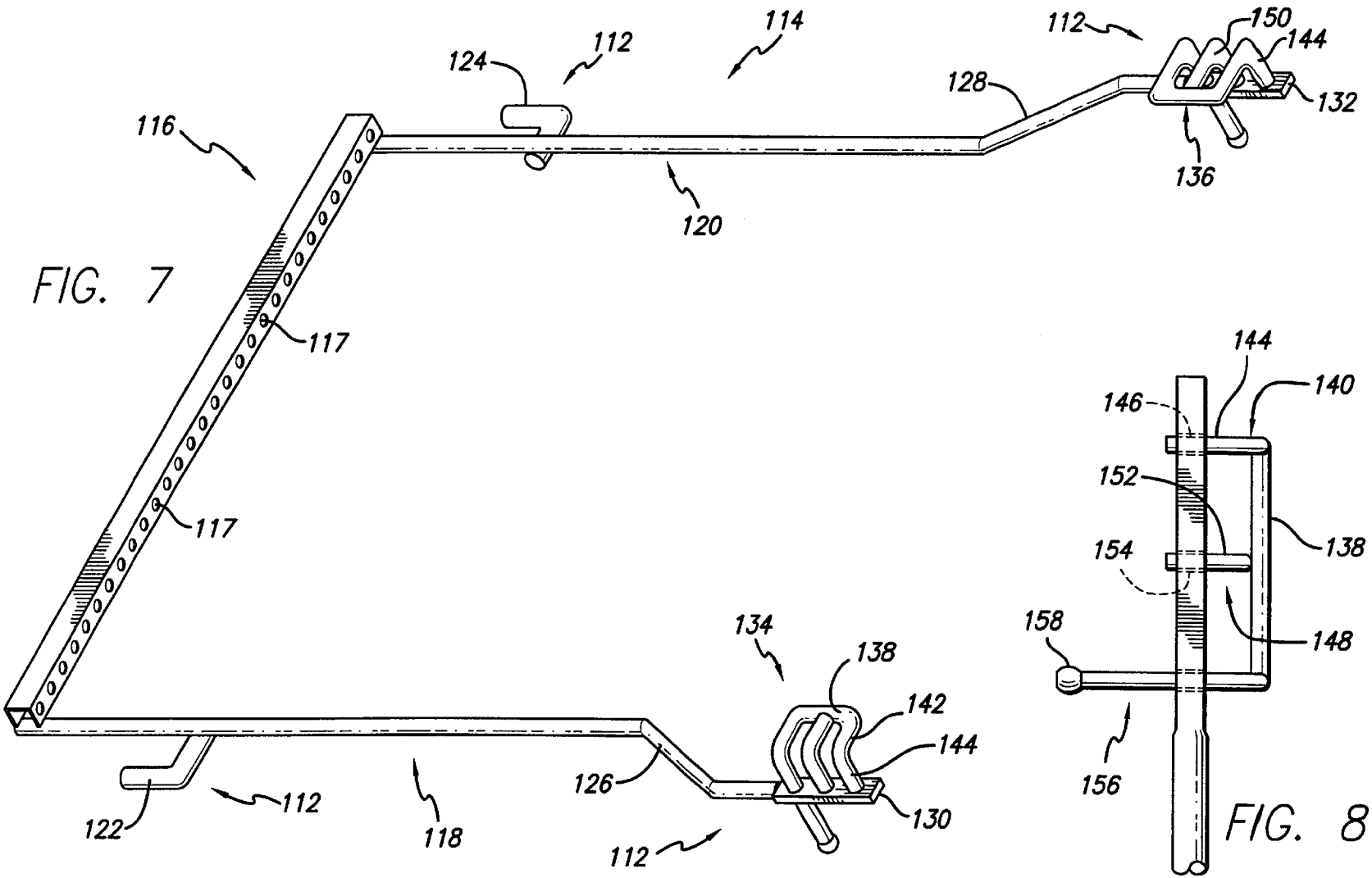
FIG. 7 is an isometric view of a front stop frame for use as a retrofit on existing shelves.
FIG. 8 is a side elevation view of a portion of the front stop frame showing a rear support rack.
Figure 9:
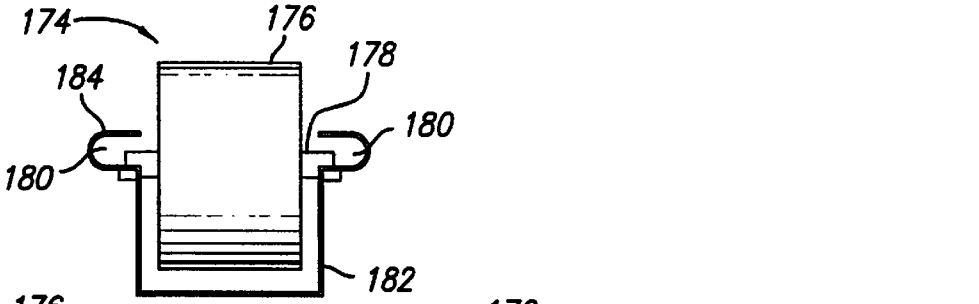
FIG. 9 is an end view of a roller cartridge for use in a flat or gravity feed shelf system using wire or other shelves having openings large enough to accommodate one or more rollers.
Figure 10:
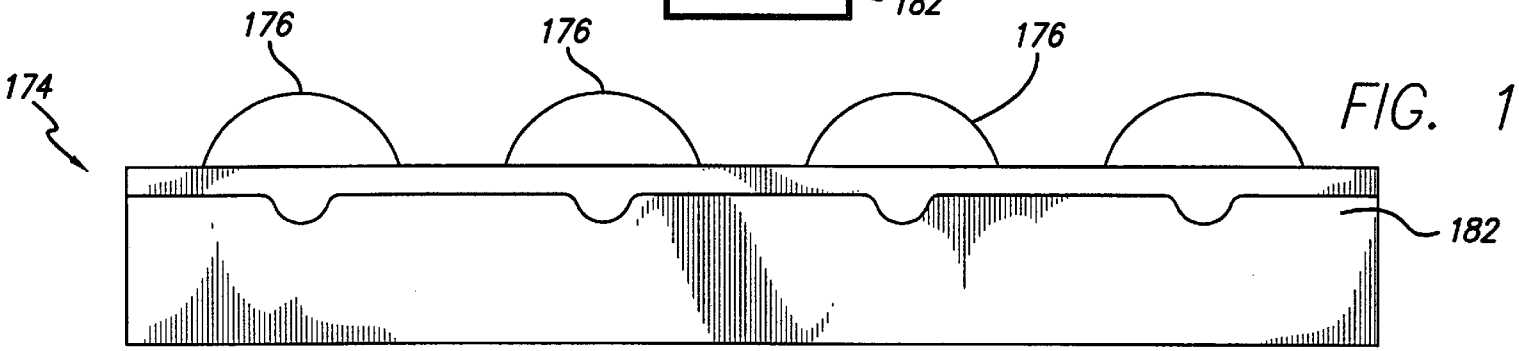
FIG. 10 is a side elevation view of the roller cartridge of FIG. 9.
Figure 11:
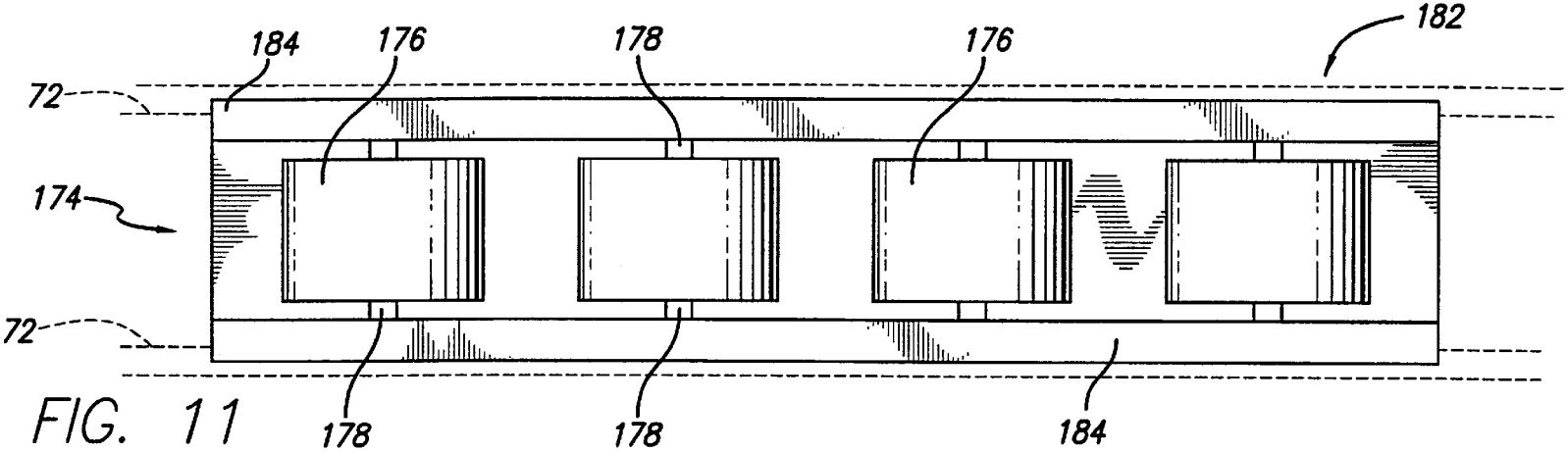
FIG. 11 is a top plan view of the roller cartridge of FIG. 9 showing one application in a wire shelf.

The shelf assembly can also include shelf or lane dividers 160. The dividers 160 preferably guide product from the rear of the shelf toward the front and keep product aligned on the shelf. The dividers are preferably positionable at a number of different locations on the shelf, after which the dividers preferably remain fixed in position and stable until removed or repositioned. The dividers are also preferably variable or adjustable in height above the wires of the shelf, to account for different sizes of product. The dividers 160 have front rearwardly extending hooks 162 for engaging the rearwardly facing apertures in the front product stop. The front product stop bar 116 also serves as a support and locator for the dividers 160. The front product stop bar 116 includes a plurality of engagement surfaces such as holes 117 for engaging the dividers 160 for supporting product. The holes 117 are preferably rearward facing and formed in the rear most surface of the product stop bar 116 so that the upward turning and rearward extending prongs or hooks on the divider can extend through and engage holes 117 on the product stop bar 116. The hooks 162 preferably engage the apertures in this direction so that product hitting the front product stop will tend to maintain engagement between the hooks 162 and the front product stop. The holes 117 are formed in the rear facing surface of the product stop bar also to minimize the likelihood that the divider would disengage from the bar 116 if a product moved forward and struck the bar. Such an impact would tend to more securely engage the hooks in the holes. As can be seen in FIG. 3, the width in the horizontal direction between the vertical walls of the bar 116 should be sufficient to permit easy access for the prongs to the holes 117.

The divider 160 also includes an upper wire 164 and a lower wire 166 extending rearwardly from the hooks 162 to forward facing hooks 168 for engaging the rearwardly opening apertures in the back stop 170. The divider preferably places the product stops under a slight compression force so as to keep the product stops and the dividers engaged.

The combination product stop and divider assembly 90 also preferably includes the back stop 170 having a rear product stop bar 172 held in the brackets 92 and supported by the brackets. The rear product stop bar 172 is preferably positioned relatively low to permit easy re-stocking of the shelf from the rear. The rear product stop bar is preferably formed at least from an angle bar, and preferably from metal sheet formed into a square cornered, U-shaped bar for structural integrity.

The rear product stop bar 172 includes a plurality of engagement surfaces such as holes 173 to support and position respective dividers 160. The dividers 160 and the rear product stop bar are preferably configured so as to place each divider 160 under tension and minimize any side to side movement under normal circumstances. As with the holes in the front product stop bar 116, the engagement surfaces may take any number of configurations, such as scalloped edges, sawtooth edges, ridges, grooves or other regular or irregular discontinuities. Preferably, the engagement surfaces are sufficiently defined to hold the divider under tension and to minimize the possibility of sideways movement under normal circumstances. Conversely, the product stop bars can be formed with projections which engage openings or other surfaces formed in dividers.

In a preferred embodiment, the rear product stop bar 170 is fixed to the shelf assembly and spaced a distance above the wires 72 to permit a glide or slide sheet to be slid under the rear product stop bar 170 and over the wires 72 for product to rest on.

As an alternative to a glide sheet, such as for large packages and corrugated boxes or containers, roller packs 174 (FIGS. 9–18) may be inserted between wires 72 on a wire shelf, and between reinforcing bars 86, to make easier moving of the packages or containers toward the front of the shelf. The roller packs 174 can be sized and configured to fit between any shape and size of wire shelf wires 72, and can be used with horizontal shelves or angled shelves. In one embodiment, one or more rollers 176, which may be made from a suitable plastic, may include axles 178 captured in channels 180 for allowing rotation of the rollers 176, while holding the rollers longitudinally stationary. The rollers are assembled in a carriage box 182 for convenient storage and for placement between individual wires 72 in a shelf. The carriage box 182 includes shoulders 184 for covering the axles 178 and for resting on the wires 72 of the shelf.

An alternative roller tray or track assembly 186 (FIG. 12) may be formed to accommodate the reinforcing bars 86 and to be simpler and less expensive to manufacture. The assembly 186 preferably includes a number of rollers 188 supported at the same level with respect to each other and with respect to the shelf wires 72 to allow product to easily rollover the tops of the rollers. The rollers are supported by a tray having a preferably rounded and closed bottom 190 connecting a right side wall 192 and a left side wall 194. The side walls extend upwardly from the bottom 190 to respective flanges, shoulders or lips 196 and 198. The flanges 196 and 198 preferably extend perpendicularly outwardly from the walls of the tray for supporting the tray on the wires 72 of the shelf. The tray rests in the gap or opening between adjacent wires 72, which opening extends longitudinally relative to the shelf. One wire 72 extends along one side of the tray and the next adjacent wire extends on the other side of the tray. Adjacent wires form first and second side elements defining the longitudinally extending opening.

Each side wall preferably includes an inside 200 (FIG. 12) and an outside 202, and the outside of the wall preferably includes at least one projection 204 extending outwardly away from the tray for contacting the lower surface of the adjacent wire 72. Each projection 204 helps to contact or engage a lower surface of the adjacent wire to reduce the possibility that the tray will come out of the opening or space between adjacent wires. The projections help to hold the tray in place. In the preferred embodiment, the projections are rounded and extend the entire length of the tray on each side surface. The projection can take any number of configurations, such as angled, pointed or peaked, rich-shaped, or the like. The space between the each projection and the adjacent flange form a longitudinally extending recess 206 for accommodating a wire 72 or other side element defining the opening into which the tray is placed.

The top of the recess 206 preferably contacts and rests on the top of the wire 72.

A groove, notch or opening 208 is formed in the bottom 190 and parts of the side walls 192 and 194 to receive or accommodate the support wires 86 so that the assembly can easily fit many of the conventional shelves. The groove extends from the bottom 190 upward past the projections 204 and into the recesses 206 so that the tray rests as low as possible on the shelf. The spacing of the groove from the end of the tray and from adjacent grooves will vary according to the spacing of the support wires 86 with respect to each other and with respect to adjacent ends of the shelf. For one common shelf, the first and last groove on the tray are centered two and ¾ and preferably less than three inches from the ends of the trays, and the intermediate grooves are spaced three inches apart to accommodate bars 86 that are either 3 inches or 6 inches apart. In this configuration, three half-inch rollers on one inch centers can be placed at the front and back of the tray without interfering with the cross bar. Three rollers also can be placed between grooves that are three inches apart. Other spacings are easily developed.

The rollers 188 shown in FIGS. 12–15 are preferably flat rollers having a substantially circular outer circumferential surface 210 supported on a circular axle 212 at each end of the roller. Each axle is supported by a respective hole 214 (FIG. 13) formed in and through each side wall 192 and 194 between the bottom of the projections 204 and the bottom of the flanges 196 and 198. The holes preferably have sufficient tolerance to permit easy rotation of the rollers. The location of the holes and the dimensions of the rollers are preferably such as to have the surfaces of the rollers well above the tops of the flanges 196 and 198, for example several percent and as high as 5% or more of the roller diameter above the flange tops, thereby minimizing any contacted between product and the flanges. Each roller preferably includes a hub surface 216 extending a slight distance from each end surface of the roller. The diameter of the hub surface 216 is preferably larger than the outside diameter of the axle 212. The hub surface 216 helps to minimize or prevent any contacted between the sides of the tray and the rest of the rollers. The rollers are preferably formed or molded from high-density polyethylene (HiD-9006) with cut outs or arcuate grooves 217 formed in the side walls to further reduce any possible friction and contact between the roller and the sides of the tray.

Figure 12:
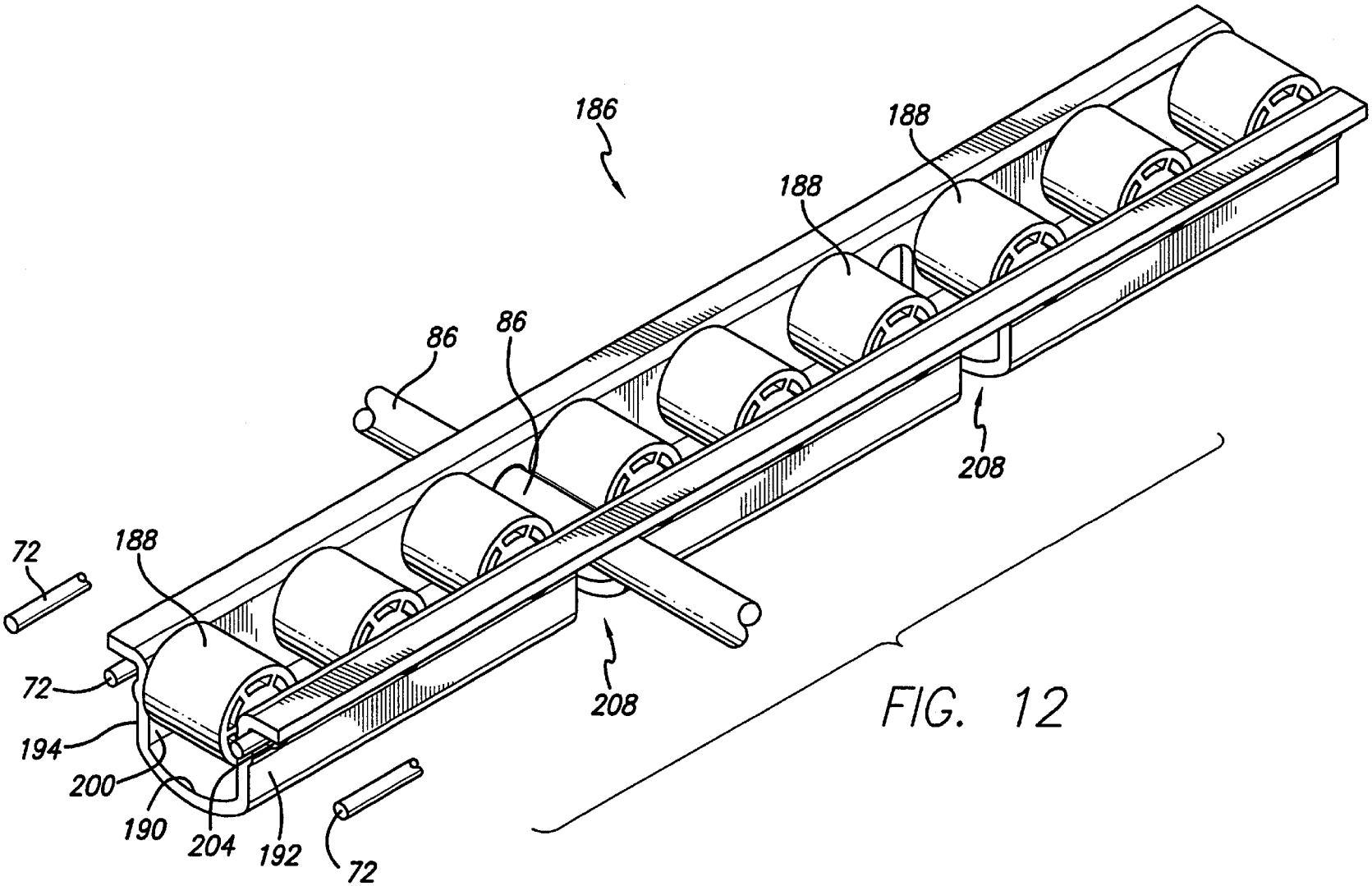
FIG. 12 is an isometric view of a roller tray on a wire shelf for supporting flat rollers.
Figure 13:
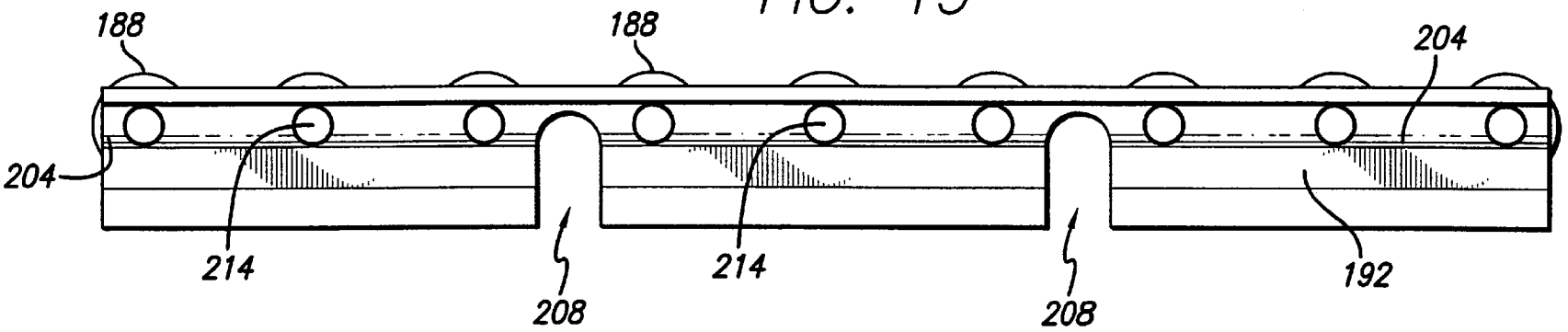
FIG. 13 is a side elevation view of the roller tray of FIG. 12.
Figure 16:
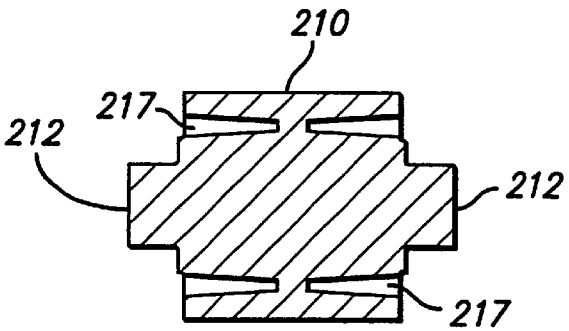
FIG. 16 is a cross section of the roller of FIG. 15.
Figure 15:
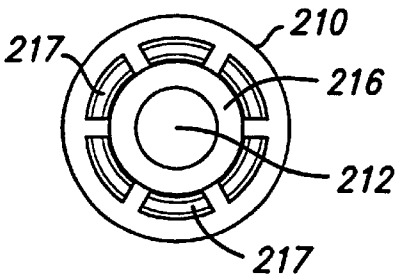
FIG. 15 is a side elevation view of a flat-surface roller.
Figure 14:
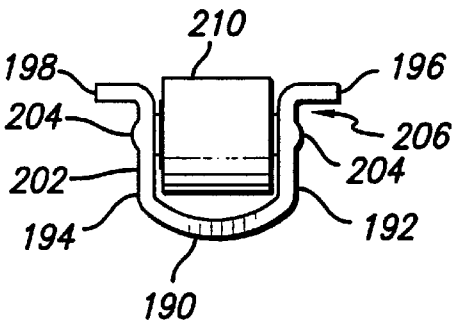
FIG. 14 is an end elevation view of the roller tray of FIG. 12.
Figures 17, 18, 19, 20:
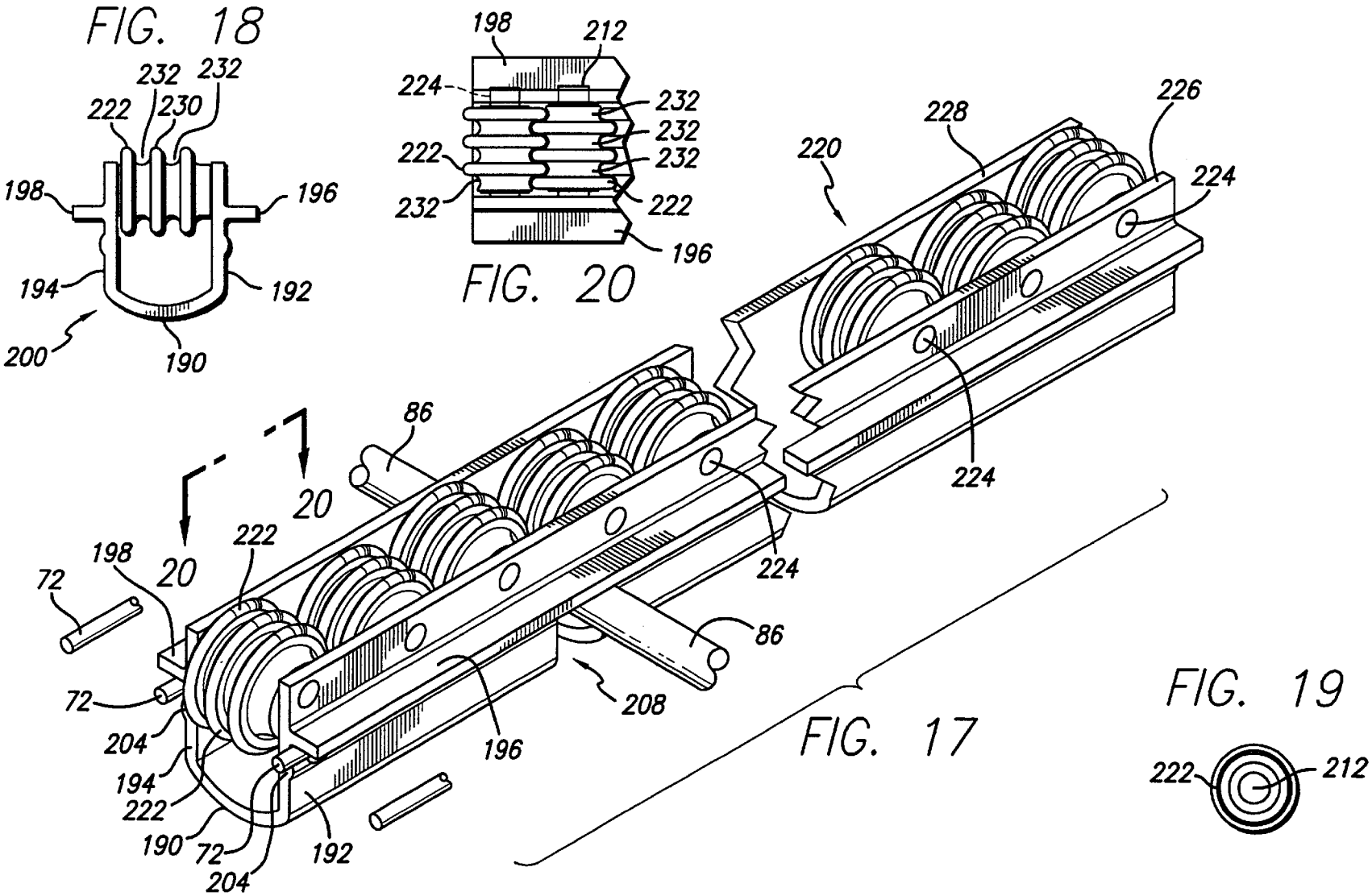
FIG. 17 is an isometric view of a roller tray for supporting grooved rollers.
FIG. 18 is an end elevation view of a grooved roller and the tray of FIG. 17.
FIG. 19 is a side elevation view of the grooved roller of FIG. 18.
FIG. 20 is a top plan view of part of the tray assembly of FIG. 17 taken along line 20—20 of FIG. 17, showing two rollers adjacent each other.

For some product, such as those having a small footprint (the size and shape of the bottom of the product which contacts the shelf or other support) the spacing of the rollers in FIG. 12 is too large. The front-end of smaller product made it between the rollers, and the product may fall forward. In an alternative embodiment, grooved rollers may be used in to reduce the gap between rollers and to reduce the possibility of product falling forward. A grooved roller assembly 220 (FIGS. 16–18) includes a tray having a bottom surface 190 and side walls 192 and 194. The tray rests in an opening defined by wires 72 and is held in place by projections 204. Flanges 196 and 198 rest on the wires 72 and keep the tray from falling through. Grooved rollers 222 are rotatably retained in openings 224 in side walls 226 and 228 extending upwardly from the flanges 196 and 198, respectively. The grooved rollers 222 are smaller in overall diameter than the flat rollers 188 and are supported by the side walls 226 and 228 to have enough clearance above the top surfaces of the tray to support product.

Each grooved roller 222 preferably includes a number of raised circumferentially extending walls, projections, ridges 230 or the like, and preferably three, for supporting product. Each grooved roller 222 also includes surfaces, grooves 232, depressions or recesses complementary to the ridges 230 so that the grooved rollers 222 can inter-fit and be supported closer together. With the grooved rollers closer together, the size of any gap between them it is substantially reduced, thereby reducing the possibility that the edges of any product will tip into the gap. In the preferred embodiment, the number of ridges 230 is equal to the number of grooves 232. The dimensions of the ridges 230 and the grooves 232 are preferably such as to minimize any contact between them for adjacent rollers.

The grooved rollers 222 are mounted in the tray 220 in alternating fashion so that the ends of adjacent rollers are complementary to each other. In other words, the end of one roller having a ridge 230 is adjacent the groove 232 end of the next roller.

As with the flat roller assembly, the dimensions of the grooved roller assembly can be selected as desired. Where the first and last grooves 208 are three inches from the respective ends of the tray, the front and rear parts of the tray can accommodate five grooved rollers of half-inch outside diameter. For groove 208 spacing of 6 inches, 10, 11 or 12 grooved rollers may be accommodated.

The roller trays can be formed in any number of configurations and sizes. For example, the assemblies can be made in segments to be placed between wire supports or only over one or less than all wire supports. The wire trays can be made to fit the entire length of the shelves, such as 23 inches for 24 inch shelves all the way up to 71 inches for 72 inch shelves. These are only examples. Some preferred dimensions for the rollers and tray assemblies include, for the flat roller, 0.610 inch diameter overall with a 0.360 inch diameter hub extending about 0.015 inch off of the rest of the roller, and a 0.219 inch diameter axle extending 0.870 inches end-to-end. The roller has about 0.032 inch of tolerance for side movement each way, for a total of about 0.064 inch. The roller is preferably made from high density polyethylene and the tray is preferably extruded rigid PVC. The flat roller tray is preferably about 0.090 inch thick except for the projection, which is preferably formed to be about 0.032 or 0.033 inch out from the surface of the tray with a radius of about 0.110 inch. The projections, the side walls and the cavity between them produce an overall width for the projections of about 0.919 inch to fit between shelf wires that are slightly smaller in spacing. The spacing from the center of the projection to the bottom of the flanges 196, 198 is about 0.183 inch. The overall width of the tray is about 1.31 inches between the ends of the flanges for resting on the shelf wires.

The grooved roller is preferably made from the same material as the flat roller, and has the same overall diameter and same axle diameter and about 0.880 inches in overall length. Each ridge 230 is preferably about 0.080 inch thick and spaced 0.132 inch apart (the groove 232 is about 0.132 inch wall-to-wall with a full radius). The ridge end of the grooved roller includes a hub of about 0.023 inch, and the width of the roller between the axles is about 0.655 inch, which is greater than the sum of the widths of the ridges and the groove, so that the end "groove" includes extra surface area forming its own hub. The grooved roller has about 0.010 inch of tolerance for side movement each way, for a total of about 0.020 inch. The tray for the grooved roller is preferably the same as that for the flat roller except for the walls 226 and 228 extending about 0.402 inch above the bottom of the flanges.

The roller assemblies can also be used in a number of different configurations, depending on product size, shelf size and the like. Typically, it is intended to use two parallel arranged sets of rollers for each product lane, and each lane will typically be separated by respective lane dividers or guides. Where the product has a small foot print, a single tray assembly may be used, and possibly the grooved roller assembly. In either case, the roller trays help to organize stock on shelves and to keep the product presentation uniformly at the front of the shelf.

Although the present inventions have been described in terms of the preferred embodiments above, the described embodiments of the invention are only considered to be preferred and illustrative of the inventive concept; the scope of the invention is not to be limited or restricted to such embodiments. Various and other numerous arrangements and modifications may be devised without departing from the spirit and scope of the inventions. Accordingly, the present invention is not limited to those embodiments precisely shown and described in the specification. It is intended that the scope of the present inventions extends to all such modifications and/or additions and that the scope of the present inventions is limited solely by the claims set forth below.

What is claimed is:

1. A shelf assembly comprising:

a shelf for supporting product;

a front product stop having a front stop bar and first and second side elements integral with and extending rearwardly from the front stop bar, wherein each of the first and second side elements include shelf support elements extending at least partly forwardly; and first and second front product stop support elements mounted to the shelf for supporting the shelf support elements of the front product stop.

2. The assembly of claim 1 wherein the shelf includes sides and wherein the first and second front product stop support elements are mounted to the sides of the shelf, and wherein each of the first and second front product stop support elements includes walls defining openings for receiving the forwardly-extending shelf support elements on the front product stop.

3. The assembly of claim 1 wherein the front stop bar includes walls defining openings facing rearwardly.

4. The assembly of claim 1 wherein the shelf support elements include engagement elements for engaging front product stop support elements.

5. The assembly of claim 4 wherein the engagement element includes a releasable locking element.

6. The assembly of claim 1 wherein the front product stop bar includes a plurality of walls defining respective openings for engaging dividers.

7. A shelf assembly comprising:

a shelf for supporting product;

a front product stop having a front stop bar and first and second side elements extending rearwardly from the front stop bar, wherein each of the first and second side elements include shelf support elements extending at least partly forwardly;

first and second front product stop support elements mounted to the shelf for supporting the shelf support elements of the front product stop;

wherein each shelf support element includes an engagement element for engaging a front product stop support element, and wherein the front product stop support element includes first and second sides and wherein the engagement element includes a first projection extending along a portion of the first side and a second projection extending along a portion of the second side.

8.The assembly of claim 7 wherein the first projection includes a first bar, the second projection includes a second bar and wherein the first and second bars are coupled to a support bar on the engagement element.

9. The assembly of claim 8 wherein the first side element on the front product stop includes a wall defining an opening for receiving the first bar on the engagement element.

10. The assembly of claim 9 wherein the first side element includes a wall defining a second opening, and wherein the engagement element includes a third bar coupled to the support bar and passing through the second opening.

11. The assembly of claim 10 wherein the third bar includes an engagement element for preventing removal of the third bar from the second opening.

12. A shelf assembly comprising:

a shelf;

first and second supports supported by the shelf, wherein each of the first and second supports are removably supported by the shelf and include a plurality of receivers for receiving a support element for a product guide;

a product guide positioned above the shelf and including at least one support element for engaging at least one of the plurality of receivers on the first support and wherein at least one support element extends at least partly forwardly for engaging the receiver; and wherein the first and second supports extend at least partly vertically and wherein the plurality of receivers also extend partly vertically to permit the product guide to be positioned at different vertical positions relative to the shelf.

13. A shelf assembly comprising:

a shelf;

first and second supports supported by the shelf, wherein each of the first and second supports are removably supported by the shelf and include a plurality of receivers for receiving a support element for a product guide;

a product guide positioned above the shelf and separable from the first and second supports and including at least one support element for engaging at least one of the plurality of receivers on the first support and wherein at least one support element extends at least partly forwardly for engaging the receiver; and further comprising third and fourth supports supported by the shelf, each having a plurality of receivers for receiving respective support elements on the product guide.

14. A shelf assembly comprising:

a shelf;

first and second supports supported by the shelf wherein each of the first and second supports are removably supported by the shelf and include a plurality of receivers for receiving a support element for a product guide; and a product guide positioned above the shelf and separable from the first and second supports and including at least one support element for engaging at least one of the plurality of receivers on the first support and wherein at least one support element extends at least partly forwardly for engaging the receiver, wherein the product guide includes a locking element for locking a portion of the product guide to at least one of the first and second supports, and wherein the locking element includes at least first and second elements coupled to the product guide spaced apart from each other to allow the first and second elements to extend on opposite sides of one of the first and second supports.

15. The assembly of claim 14 wherein the product guide includes at least a first wall for defining an opening for receiving one of the first and second elements.

16. A shelf assembly comprising:

a shelf;

first and second supports supported by the shelf, wherein each of the first and second supports are removably supported by the shelf and include a plurality of receivers for receiving a support element for a product guide; and a product guide positioned above the shelf and separable from the first and second supports and including at least one support element for engaging at least one of the plurality of receivers on the first support and wherein at least one support element extends at least partly forwardly for engaging the receiver, wherein the product guide includes a locking element for locking a portion of the product guide to at least one of the first and second supports, and wherein the locking element locks a portion of the product guide to the first support and includes at least one element coupled to the product guide for substantially preventing the product guide from disengaging from the receiver.

17. The assembly of claim 16 wherein the at least one element extends on a forward side of the receiver to substantially prevent the product guide from moving rearward.

18. The assembly of claim 17 further comprising a second element extending on a rearward side of the receiver to substantially prevent the product guide from moving forward.

19. The assembly of claim 16 wherein the locking element movably retains the locking element so that the locking element can move from a locked position to an unlocked position.

20. The assembly of claim 16 wherein the locking element is positioned on the product guide rearward of the at least one support element.

21. A shelf assembly comprising:

a shelf;

first and second supports supported by the shelf, wherein each of the first and second supports are removably supported by the shelf and include a plurality of receivers for receiving a support element for a product guide; and a product guide positioned above the shelf and separable from the first and second supports and including at least one support element for engaging at least one of the plurality of receivers on the first support and wherein at least one support element extends at least partly forwardly for engaging the receiver, wherein the product guide includes a locking element for locking a portion of the product guide to at least one of the first and second supports, and wherein the product guide includes third and fourth product guide support elements, the assembly further comprising third and fourth supports supported by the shelf for supporting the product guide, each having a plurality of receivers for receiving respective third and fourth product guide support elements on the product guide, and wherein the locking element engages the third product guide support element.

22. The assembly of claim 21 wherein the product guide includes first and second locking elements.

23. A shelf assembly comprising:

a shelf for supporting product;

a front product stop having a front stop bar and first and second side elements extending rearwardly from the front stop bar, wherein each of the first and second side elements include shelf support elements extending at least partly forwardly; and first and second front product stop support elements mounted to the shelf for supporting the shelf support elements of the front product stop, and wherein the first and second front product stop support elements include walls defining openings arranged vertically with respect each other so that the front product stop can be positioned at more than one height from the shelf and wherein the front product stop bar includes a plurality of walls defining respective openings for engaging dividers.

24. A shelf assembly comprising:

a shelf for supporting product;

first, second, third and fourth supports removably supported by the shelf, each support including a plurality of receivers for receiving a support element for a product guide;

a product guide having a front product stop bar and first and second side elements extending rearwardly from the front stop bar and including first and second forward-facing elements on respective first and second side elements for engaging receivers in respective first and second supports on the shelf, and wherein the first and second side elements engage the third and fourth supports on the shelf; and at least one locking element for locking the product guide relative to one of the supports on the shelf.

* * * * *